United States Patent [19]

Hubert

[11] 4,020,815

[45] May 3, 1977

[54] ENGINE CARBURETOR AIR INTAKE HEATER APPARATUS

[76] Inventor: Richard D. Hubert, Rte. No. 5, Box 532, DeLand, Fla. 32720

[22] Filed: May 5, 1975

[21] Appl. No.: 574,277

[52] U.S. Cl. ..... 123/142.5 R; 123/122 D; 123/122 F; 123/119 C

[51] Int. Cl.[2] ..... F02N 17/02

[58] Field of Search ..... 123/122 D, 122 F, 122 H, 123/119 C, 142.5 R, 142.5 E, 179 H; 219/206, 207; 261/142

[56] References Cited

UNITED STATES PATENTS

| | | | |
|---|---|---|---|
| 2,681,646 | 6/1954 | Holpfer | 123/119 C |
| 2,918,787 | 12/1959 | Schelp | 123/119 C |
| 3,397,684 | 8/1968 | Scherenberg | 123/122 D |
| 3,441,011 | 4/1969 | Karl | 123/122 D |
| 3,492,457 | 1/1970 | Subt | 219/207 |
| 3,728,856 | 4/1973 | Scherenberg | 123/122 D |
| 3,880,152 | 11/1974 | Hollins | 123/122 D |

*Primary Examiner*—Ronald H. Lazarus
*Attorney, Agent, or Firm*—Duckworth, Hobby, Orman Allen & Pettis

[57] ABSTRACT

An air heater and blower system is incorporated into an air filter for an internal combustion engine carburetor and blows heated air into the filter and into the carburetor under control of a thermostat. The air filter has an opening and a deflector plate to deflect some of the heated air against the carburetor and bowl beneath the filter so as to accumulate heat around the carburetor under the filter casing thereby increasing the efficiency of the engine in cold weather or when the temperature drops below the setting of the thermostat.

10 Claims, 5 Drawing Figures

M 11
12
13
15
16
18
20
21
25
28
31
32
33
34
35
36
37
38
M

ENGINE CARBURETOR AIR INTAKE HEATER APPARATUS

BACKGROUND OF THE INVENTION

The present invention relates to carburetors and carburetor air filters and especially to a system for heating the air passing through the carburetor by means of an independent heating element and blower.

In the past, it has been common to provide carburetors on internal combustion engines with various devices to increase the efficiency of the carburetor during normal operation and especially during warm up of the engine when the car is first started. In normal operation, heated water from the engine is sometimes directed adjacent the carburetor to heat the carburetor and the gas and air passing therethrough to increase the efficiency of the operation of the vaporization of the gas and of the operation of the engine. Many internal combustion engines on automobiles have valves for directing warm exhaust air into pipes adjacent the carburetor for heating the carburetor rather than using hot water. However, these heating devices are ineffective until the engine is sufficiently warm to produce the necessary heat to heat the carburetor and the gas being fed thereinto. To start a cold engine, a choking mechanism is generally used which reduces the amount of air that enters the carburetor relative to the amount of gas being fed to the carburetor to substantially enrich the mixture of the air being fed to the engine until the engine is warmed up. In addition, accelerator valves and other devices splash gasoline into the carburetor to substantially enrich the mixture. This makes the engine start better and run better initially but substantially reduces the efficiency of the engine which frequently also has a device for increasing the idling speed of the engine while the engine is warming up and thereby further reducing the efficiency of operation of the engine. It has also been suggested in various prior patents to provide various means for heating the gasoline being fed to the carburetor along with heating elements and the like and also to return exhaust gases to the intake manifold in order to reduce the pollution output of the engine.

In addition, there have been various U.S. patents for heating the air and gas being fed to the carburetor such as U.S. Pat. No. 3,653,366 for a control device for the air intake of carburetor-type internal combustion engines and U.S. Pat. No. 3,777,728 for a process and apparatus for assisting in starting internal combustion engines by heating the intake air of an fuel-air mixture before the air reaches the carburetor of the engine with a halogen bulb enclosed by a metal grid through which the intake air flows. U.S. Pat. No. 3,782,349 teaches an intake air temperature automatic adjusting device and air cleaner with such device for internal combustion engines while U.S. Pat. No. 2,756,730 teaches a water cooler and hot air intake assembly in which the heated water from the engine cooling system heats the intake air being fed to the carburetor. U.S. Pat. No. 3,830,210 illustrates an air intake system with a temperature control warm air valve which directs warm air via a flat valve to the air filter from the manifolds of the engine. U.S. Pat. No. 3,672,342 illustrates a system for controlling air and fuel temperature utilizing a small heat exchanger for mixing heated and ambient air being fed to the carburetor while U.S. Pat. No. 1,381,434 illustrates a liquid fuel internal combustion engine of an older type.

The present invention on the other hand teaches a system which is readily attachable to existing vehicles or which may be added to new vehicles which allows the air to be heated in a cold engine just being started and to heat the air, as well as to direct some of the heated air for heating the carburetor and gas being fed to the carburetor while also applying a positive pressure of air from a blower.

SUMMARY OF THE INVENTION

The present invention relates to internal combustion engines and especially to internal combustion engines for automobiles and to carburetors for vaporizing the fuel for the vehicle. A carburetor air cleaner adapted to fit upon an engine carburetor is provided with a plurality of electrical heating elements to heat the air passing into the air cleaner and into the carburetor. The heating elements are thermostatically controlled to operate only when the entering air is blowing a predetermined temperature and an electrical motor driven blower is attached to the air cleaner casing to blow warm air into the air filter and into the carburetor. An opening in the bottom of the air cleaner has a deflector plate for directing warm air against the carburetor bowl and beneath the air filter casing for the accumulation of warm air thereunder for heating the carburetor and the gas therein being fed into the carburetor. The blower has a swirl plate for causing a swirling motion of the air entering the air cleaner to increase the efficiency of the flow of the air and an adjustable thermostat for disengaging the heating elements when the air passing therethrough reaches a predetermined temperature.

BRIEF DESCRIPTION OF THE DRAWINGS

Other features and advantages of the present invention will be apparent from the written description and the drawings in which.

DESCRIPTION OF THE PREFERRED EMBODIMENT

Figures 1, 2:
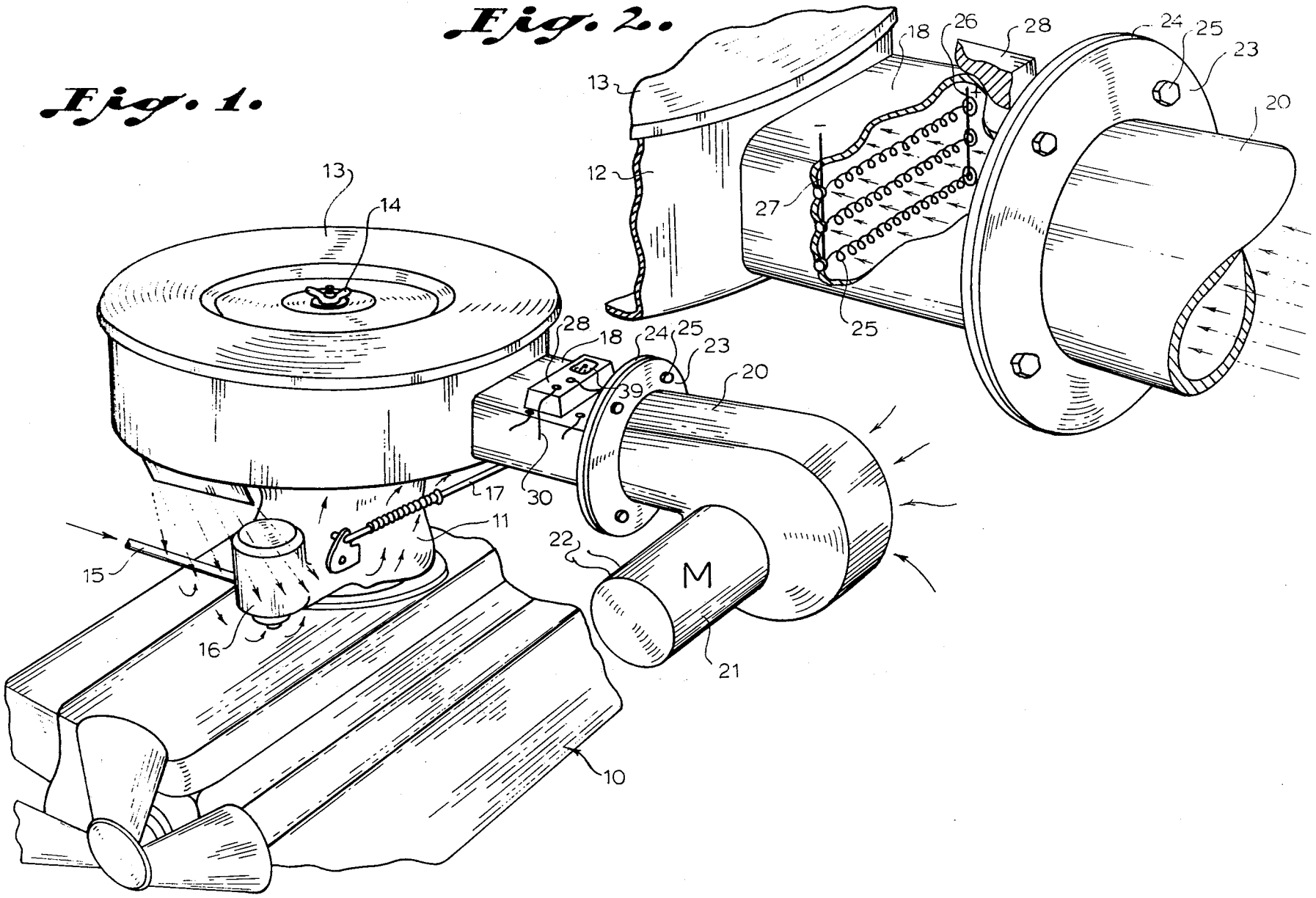
FIG. 1 is a perspective view of the present invention attached to the carburetor of an internal combustion engine.
FIG. 2 is a cutaway perspective view of the heating elements of the invention of FIG. 1.

Referring now to the drawings, an engine 10 is illustrated having a carburetor 11 attached thereto with an air filter casing 12 mounted on the carburetor 11. Air filter casing 12 has a removable top 13 held with a wing nut 14 which top 13 allows the removal and replacement of an air filter. Carburetor 11 has a fuel line 15 feeding into the carburetor bowl 16 where the gas is held temporarily while being fed into the throat of the carburetor. The carburetor also has an accelerator linkage 17. The air filter 12 has an air intake spout 18 whereby air comes into the air spout 18 at the opening, circles around the filter inside the filter casing 12 and into the throat of the carburetor 11.

In the present invention a squirrel cage blower 20 has an electric motor drive 21 connected by electrical conductors 22 through the ignition switch to the battery of the vehicle. The blower 20 is attached through a flange 23 to cover the end of the air intake spout 18 which has been provided with a flange 24 which flanges may be bolted together with bolts 25. It will, of course, be clear that other means of attaching the air blower 20 to the filter casing 12 or air intake spout 18 can be provided without departing from the spirit and scope of the invention. The blower 20 blows a larger volume of air under increased pressure into the air filter casing 12 and into the throat of the carburetor 11. A plurality of heating elements 25 have been mounted in the air intake spout 18 from the positive base 26 across to a negative base 27 so as to heat the air passing through the air intake spout 18 and into the carburetor. Heating elements 25 are connected through a thermostat 28 having a control panel 30 for adjusting the exact temperature in which the heating elements 25 are to come on and be disconnected. The thermostat in turn is connected through conductors 30, and through the ignition switch to the battery. The particular thermostat in this case is a flat plate thermostat having a plate on the bottom thereof that reads the temperature for actuating the thermostat. It will, of course, be clear that other types of thermostats, such as those having a probe sticking into the passageway of the air intake spout 18, may also be utilized within the scope of the invention.

At this point it can be seen that the blower 20 applies positive air pressure into the spout 18 and into the air filter casing 12 to the carburetor, blowing the air past the heating elements so that warm air is directed into the carburetor. This allows better vaporization of the fuel and allows a better operation of the engine during starting and warm up and also allows the carburetor 11 to be utilized without an automatic choke which is one of the more troublesome features of most carburetors while increasing the efficiency of the engine and saving fuel. The air being blown into the casing 12 which has been warmed is also directed through an opening 31 located in the bottom of the filter casing 12 and having a deflector plate 32 thereon which can be cut and formed directly from the bottom of the casing 12. The opening is located directly over the carburetor fuel bowl 16 so that warm air is directed directly thereupon as soon as the ignition is turned on to start warming the gas in the bowl prior to the gas entering the carburetor which is accomplished very rapidly because of the warm air blowing directly upon the metal. The air also circulates around the carburetor, and accumulates under the filter casing 12 which casing generally has an arcuate under surface 33 to help maintain the warm air while the entire carburetor is being warmed. Once the engine is warmed up and warm air is being received by air filter casing 12 having an air filter 34 therein, the thermostat 28 will switch off the heating coils 25. The filter 34 forces the air which is being applied under greater pressure and a higher velocity into the casing 12 to circulate around the outside of the filter 34 thereby directing additional air through the opening 31.

Figures 3, 4:
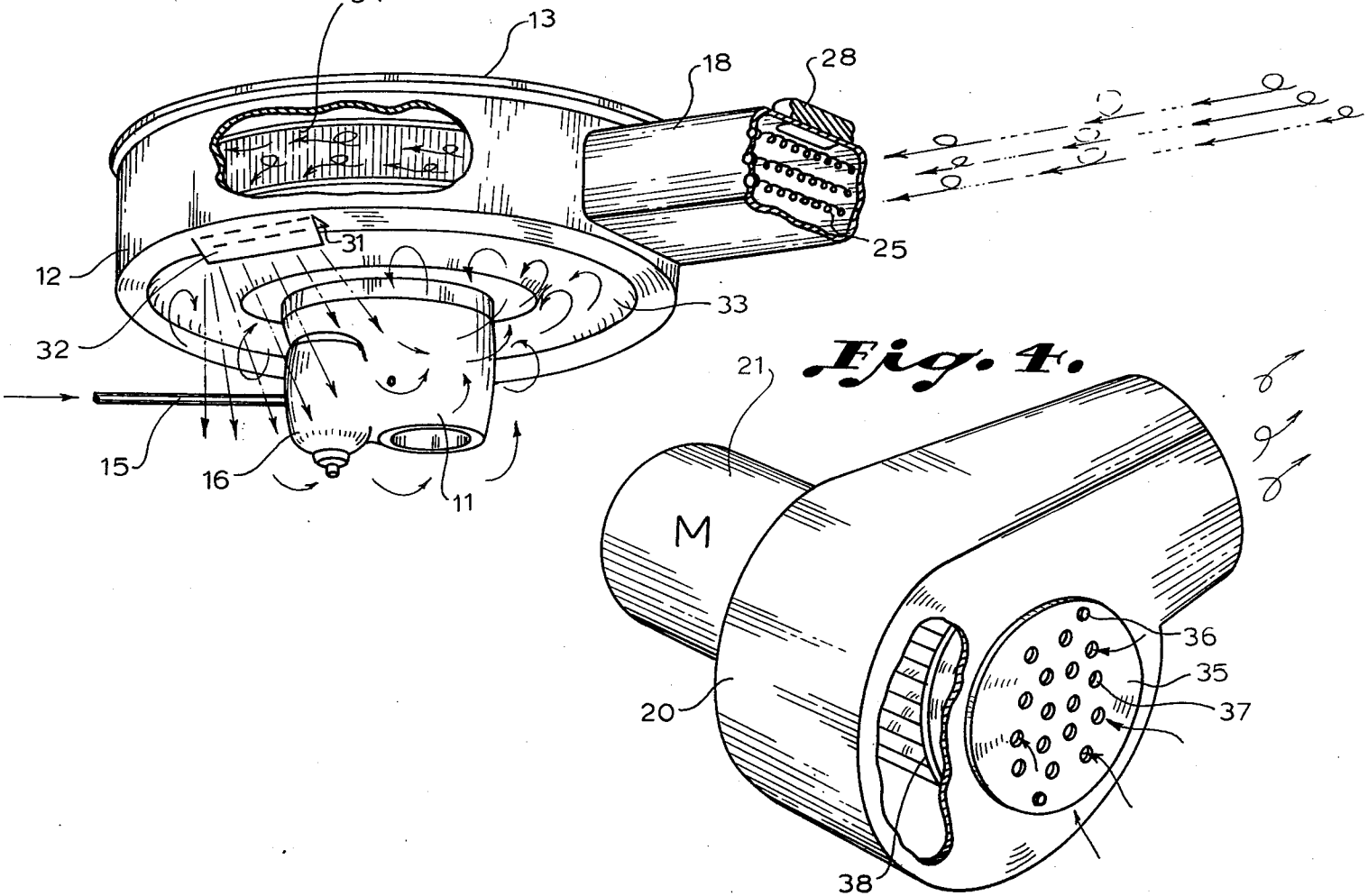
FIG. 3 is a cutaway perspective view of the heating elements and air cleaner illustrating the flow of air through the air filter casing.
FIG. 4 is a perspective view of a blower having a swirl plate attached thereto.

In FIG. 4 a swirl plate 35 is illustrated attached by bolts 36 to the blower 20 which plate has a disc shape and has randomly placed openings 37 therethrough which forces the air to circulate or swirl better, increasing the turbulence and efficiency of the system. The blades 38 of the squirrel cage blower 20 can also be seen in this view. It should, of course, be clear that while a particular swirl plate 35 has been illustrated, other types such as those having vanes or slits can also be utilized without departing from the spirit and scope of the invention.

Figure 5:
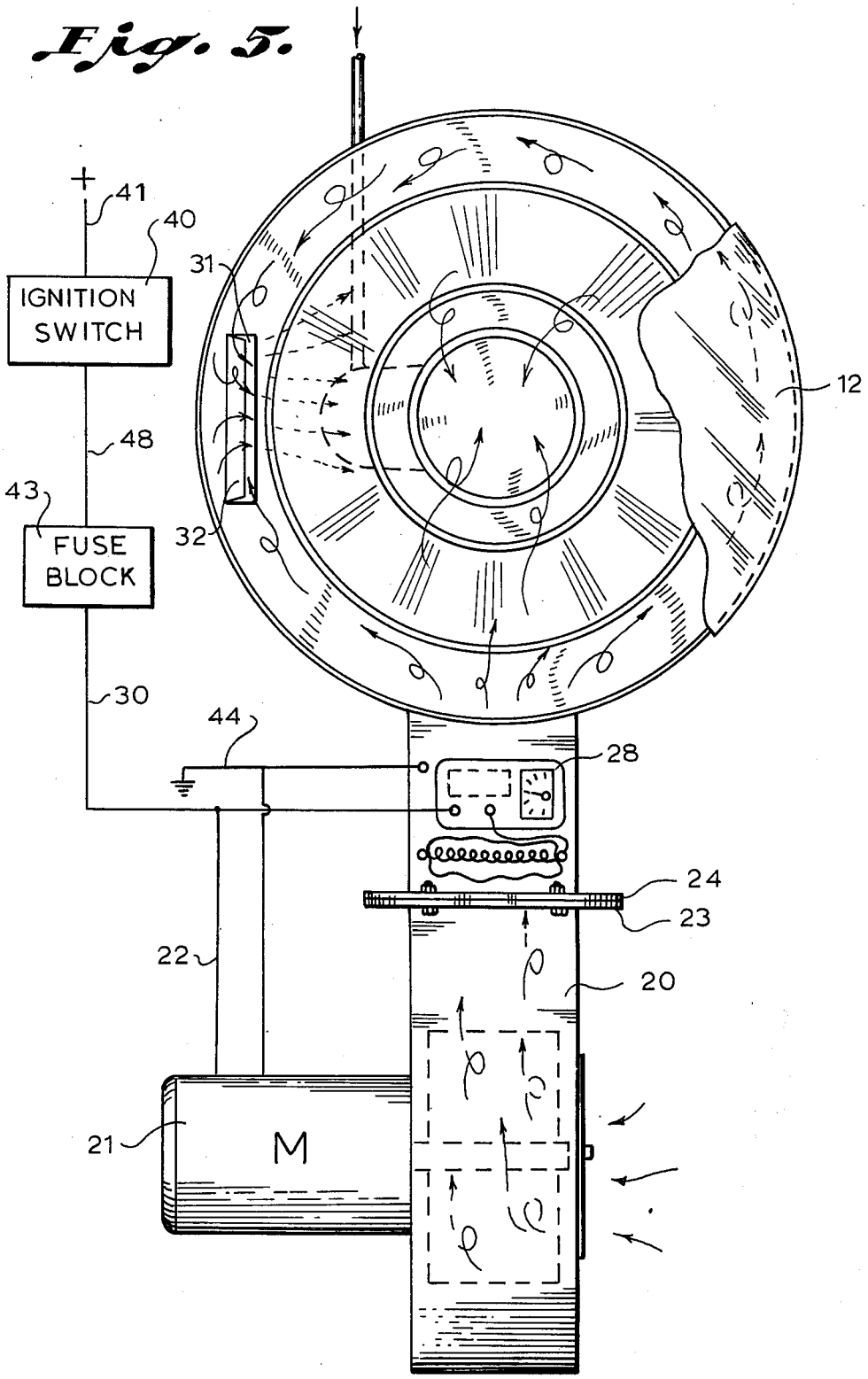
FIG. 5 is a cutaway top plan view and electrical schematic of the invention illustrating the flow of the air and the operation of the system.

FIG. 5 more clearly shows the overall operation including a wiring diagram having the ignition switch 40 which is connected through a conductor 41 to the battery and through a conductor 42 to a fuse block 43 which in turn is connected through a conductor 30 to the thermostat 28. The fuse block is also connected through conductors 22 to the motor 21 and both are connected to ground through a ground wire 44.

It should be clear at this point that an improved carburation system has been provided in which actuation of the ignition of a vehicle will allow warm air to be directed directly into the carburetor and around the carburetor to warm the carburetor providing conditions in the carburetor similar to those that are provided in a warmed up engine thereby eliminating the necessity of an automatic choke and improving the efficiency by reducing the inefficiency of the enriched mixtures, and the sloshing of gas in a cold engine while also providing additional advantages such as slower idling during warm up with the elimination of special fast idling mechanisms while reducing dieseling of the heating engine by the continued blowing of air by the blower 20. It will, of course, be clear that the blower 20 operates at all times giving an increased air pressure to the carburetor while the heating elements are switched on and off automatically by the thermostat 28. Thus, the air being blown by the blower 20 into the air intake 12 and through the opening 31 actually helps cool the carburetor after the engine has been substantially warmed up.

The present invention stabilizes the temperatures of the air and fuel entering the carburetor at all times that the engine is in operation by heating the cold carburetor, air and fue when starting the engine and then cooling the carburetor once the engine is heated up. The carburetor, fuel and air may be preheated by turning the ignition on prior to starting the engine. It should, therefore, be clear that other embodiments are contemplated as being within the scope of the invention which is not to be construed as limited to the particular forms disclosed herein since these are to be regarded as illustrative rather than restrictive.

I claim:

1. An engine carburetor air heater apparatus comprising in combination:

a carburetor air cleaner casing adapted to fit upon and be attached to a carburetor;

electric heating means attached to said air cleaner casing for heating air passing thereby into a carburetor;

an electric motor driven blower means attached to said air cleaner for blowing air by said heating elements through said air filter into a carburetor; and said air cleaner casing having an opening therein through the bottom portion thereof and being located to direct air under pressure from said electric motor driven blower means onto the outside of a carburetor to which the air cleaner casing is attached whereby said carburetor and fuel passing therethrough may be heated prior to starting an engine.

2. The apparatus in accordance with claim 1 in which said carburetor air cleaner casing has a deflector plate located adjacent said opening to deflect air directly against the fuel bowl of the carburetor to which the air cleaner casing is attached.

3. The apparatus in accordance with claim 2 in which a thermostat is mounted onto said air cleaner casing for disengaging said heating means when said thermostat reaches a predetermined level.

4. The apparatus in accordance with claim 3 in which said heating means has a plurality of heating elements connected to opposite poles on an electric source and extending across an intake air spout of said carburetor air cleaner casing.

5. The apparatus in accordance with claim 4 in which said blower means includes attachment means for removably attaching said blower to said air cleaner.

6. The apparatus in accordance with claim 5 in which said blower means has a swirl plate mounted to increase swirling turbulence into the air entering the blower and being directed into the air filter casing.

7. The apparatus in accordance with claim 6 in which said electrically driven blower means and thermostat are connected through the ignition switch for actuating the engine to which the carburetor and air cleaner are attached.

8. The apparatus in accordance with claim 7 in which said blower and heating elements are connected through a master switch for disengaging both by an operator.

9. The apparatus in accordance with claim 8 in which said air cleaner casing is attached upon a carburetor having the choke removed therefrom.

10. The apparatus in accordance with claim 9 in which said thermostat is adjustable for actuation at different temperatures.

* * * * *